US012012716B2

(12) United States Patent
Suzuki et al.

(10) Patent No.: US 12,012,716 B2
(45) Date of Patent: Jun. 18, 2024

(54) WORK MACHINE

(71) Applicant: HITACHI CONSTRUCTION MACHINERY CO., LTD., Tokyo (JP)

(72) Inventors: Yusuke Suzuki, Tsuchiura (JP); Hiroaki Tanaka, Kasumigaura (JP); Hisami Nakano, Tsuchiura (JP); Hiroshi Sakamoto, Kashiwa (JP); Akihiro Narazaki, Tsukuba (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 273 days.

(21) Appl. No.: 17/434,491

(22) PCT Filed: Aug. 3, 2020

(86) PCT No.: PCT/JP2020/029704
§ 371 (c)(1),
(2) Date: Mar. 18, 2022

(87) PCT Pub. No.: WO2021/059749
PCT Pub. Date: Apr. 1, 2021

(65) Prior Publication Data

US 2022/0220694 A1 Jul. 14, 2022

(30) Foreign Application Priority Data

Sep. 25, 2019 (JP) ..... 2019-174611

(51) Int. Cl.
*E02F 3/43* (2006.01)
*E02F 3/32* (2006.01)
(Continued)

(52) U.S. Cl.
CPC ..... *E02F 3/435* (2013.01); *E02F 3/32* (2013.01); *E02F 9/2203* (2013.01); *E02F 9/262* (2013.01);
(Continued)

(58) Field of Classification Search
CPC . E02F 3/32; E02F 9/2203; E02F 9/262; E02F 9/2004; E02F 9/2225; E02F 9/2285; E02F 9/2246
See application file for complete search history.

(56) References Cited

U.S. PATENT DOCUMENTS

2014/0178166 A1 6/2014 Andruch, III et al.
2014/0190153 A1 7/2014 Britten et al.
(Continued)

FOREIGN PATENT DOCUMENTS

CN 105339558 A 2/2016
JP 5519414 B2 6/2014
(Continued)

OTHER PUBLICATIONS

Korean Office Action received in corresponding Korean Application No. 10-2021-7025263 dated Feb. 24, 2023.
(Continued)

*Primary Examiner* — Aaron L Troost
(74) *Attorney, Agent, or Firm* — MATTINGLY & MALUR, PC

(57) ABSTRACT

In a hydraulic excavator including a main controller that can execute area restriction control, the main controller is configured to calculate an operation velocity Vix of a front work device in a machine body coordinate system. The controller is further configured to calculate a movement velocity (dragging velocity) of a machine body in a gravity coordinate system and correct a direction of a calculated target velocity vector upward away from a construction target surface when generation of dragging is detected during execution of the area restriction control based on the calculated operation velocity of the front work device and the calculated movement velocity of the machine body.

8 Claims, 12 Drawing Sheets

(51) Int. Cl.
*E02F 9/20* (2006.01)
*E02F 9/22* (2006.01)
*E02F 9/26* (2006.01)

(52) U.S. Cl.
CPC ..... *E02F 9/2004* (2013.01); *E02F 9/2225* (2013.01); *E02F 9/2285* (2013.01)

(56) References Cited

U.S. PATENT DOCUMENTS

| | | | |
|---|---|---|---|
| 2016/0281331 | A1 | 9/2016 | Ikegami et al. |
| 2020/0018045 | A1 | 1/2020 | Sano et al. |
| 2020/0208373 | A1 | 7/2020 | Nakamura et al. |

FOREIGN PATENT DOCUMENTS

| | | | | | |
|---|---|---|---|---|---|
| JP | 2014-122511 | A | | 7/2014 | |
| JP | 2014122511 | A | * | 7/2014 | ..... E02F 3/32 |
| JP | 2014-525549 | A | | 9/2014 | |
| JP | 2016-173032 | A | | 9/2016 | |
| JP | 2018-003282 | A | | 1/2018 | |
| JP | 2019-007175 | A | | 1/2019 | |
| JP | 2019-157362 | A | | 9/2019 | |
| WO | 2018/164172 | A1 | | 9/2018 | |

OTHER PUBLICATIONS

Chinese Office Action received in corresponding Chinese Application No. 202080014068.9 dated Apr. 19, 2022.

International Preliminary Report on Patentability received in corresponding International Application No. PCT/JP2020/029704 dated Apr. 7, 2022.

International Search Report of PCT/JP2020/029704 dated Oct. 27, 2020.

* cited by examiner

[b] RELATION BETWEEN MAGNITUDE OF TARGET VELOCITY VECTOR AND PROPORTIONAL CONSTANT

[a] RELATION BETWEEN TARGET SURFACE DISTANCE AND PROPORTIONAL CONSTANT

[a] CASE WHERE DRAGGING IS ABSENT

[b] CASE WHERE DRAGGING IS BEING RESTRAINED

FIG. 12

| STATE | FRONT DEVICE VELOCITY (Vfx) | DRAGGING VELOCITY (Vu) | DRAGGING RATIO ( $\varepsilon$ ) | CORRECTION AMOUNT( $\theta$ ) |
|---|---|---|---|---|
| 1 | FAST | SLOW | SMALL | CORRECT SLIGHTLY UPWARD |
| 2 | FAST | FAST | LARGE | CORRECT LARGELY UPWARD |
| 3 | SLOW | SLOW | LARGE | CORRECT LARGELY UPWARD |

WORK MACHINE

TECHNICAL FIELD

The present invention relates to a work machine to be used for road construction, construction work, civil engineering works, dredging work, or the like.

BACKGROUND ART

As a work machine to be used for road construction, construction work, civil engineering works, dredging work, or the like, there is known one in which a swing structure is swingably attached to an upper portion of a track structure traveling by a power system, an articulated front work device is vertically pivotably attached to the swing structure, and each of front members constituting the front work device is driven by a cylinder. Examples thereof include a hydraulic excavator having a front work device including a boom, an arm, a bucket, and the like. The hydraulic excavator of this kind includes a hydraulic excavator in which an area in which the front work device can be operated is provided in relation to a construction target surface and when an operation input is given from an operator, the front work device is semiautomatically operated within the area, or generally-called area restriction control (broadly speaking, referred to as machine control or semiautomatic control) is conducted. The machine control of this kind includes one in which an operation velocity of the boom is restricted (decelerated) according to the construction target surface and the bucket such that the bucket would not enter below the construction target surface even when a boom operation is conducted, and the boom is finally stopped above the construction target surface. In addition, there is one in which, when an arm operation is inputted by the operator during excavation, the boom or the bucket is semiautomatically operated according to the arm operation and the claw tip of the bucket is moved along the construction target surface, or one in which the angle of the bucket in that instance is kept constant.

Incidentally, when excavation is conducted by use of a hydraulic excavator, there is a case where the track structure is set on a slippery road surface, or a case where the excavation reaction force by a ground to be excavated is enlarged due to an excavation obstacle such as a rock. In such a case, if the excavation force of the front work device exceeds the pulling force (maximum static frictional force) of the machine body, the work machine body (swing structure and track structure) would be dragged in a direction of the front work device (hereinafter, this phenomenon may be referred to as "dragging"). If the work machine body is dragged, the operator should once stop the excavation and should perform a correcting operation, for correcting the position of the track structure (for example, for returning the track structure to an original position). Therefore, efficiency of the excavation would be lowered. When excavation is conducted in an easily draggable condition, for example, dragging can be prevented by the operator adjusting an excavation amount of the bucket to a smaller amount, but this requires a skillful operation.

In order to solve this problem, Patent Document 1 and Patent Document 2 disclose a mechanism of a hydraulic excavator in which an excavation reaction force is estimated based on a posture of the hydraulic excavator, and a pressure of an arm cylinder is controlled such that the pressure does not exceeds a pressure value corresponding to the excavation reaction force. According to this technology, the pressure of the arm cylinder is restricted such that the work machine body would not be dragged, and the operation of the arm cylinder is stopped before generation of dragging.

PRIOR ART DOCUMENT

Patent Documents

Patent Document 1: JP-2014-122511-A
Patent Document 2: JP-2016-173032-A

SUMMARY OF THE INVENTION

Problem to be Solved by the Invention

Here, application of the technology of Patent Document 1 and the Patent Document 2 to a hydraulic excavator capable of performing area restriction control in which excavation along a construction target surface is conducted by automatically operating a boom and a bucket in response to an operator's arm operation is considered. In this case, when the pressure of the arm cylinder reaches an estimated pressure value corresponding to an excavation reaction force during triggering of the area restriction control based on the arm operation, the operation of the arm cylinder is stopped, and generation of dragging is prevented. However, since the excavation by the arm operation cannot be continued in that state, the operator, by changing the posture of the front work device by a boom operation or a bucket operation, should escape from the situation in which the pressure of the arm cylinder can reach the above-mentioned pressure value. Therefore, when the technology of Patent Document 1 and Patent Document 2 is applied to the hydraulic excavator capable of performing area restriction control (machine control), the semiautomatic operation which is a merit of the machine control may be temporarily interrupted, so that operator's operability and workability may be lowered.

The present invention has been made in consideration of the above problem. It is an object of the present invention to provide a work machine capable of performing area restriction control (machine control) and capable of preventing generation of dragging of the machine body without stopping the arm cylinder during triggering of the area restriction control (machine control).

Means for Solving the Problem

While the present application includes a plurality of means for solving the above-mentioned problem, one example thereof is a work machine including: a machine body having a track structure and a swing structure attached to an upper portion thereof; an articulated work device attached to the swing structure; a plurality of actuators that are driven by a hydraulic working fluid delivered from a hydraulic pump and that operate the work device; an operation lever that instructs the work machine on an operation according to an operator's operation; and a controller configured to calculate a target velocity vector of the work device such that a position of the work device is maintained on a predetermined construction target surface or above an upper side thereof while the operation lever is operated, and perform an area restriction control of controlling at least one of the plurality of actuators such that the work device is operated according to the calculated target velocity vector, in which the controller is configured to calculate an operation velocity of the work device in a machine body coordinate system and a movement velocity of the machine body in a gravity coordinate system, and correct a direction of the calculated target velocity vector upward away from the construction target surface when occurrence of dragging is detected during execution of the area restriction control based on the calculated operation velocity of the work device and the calculated movement velocity of the machine body.

Advantages of the Invention

According to the present invention, since generation of dragging of the machine body can be prevented without stopping the arm cylinder during triggering of area restriction control (machine control), an operator's operability and workability are not impaired largely.

BRIEF DESCRIPTION OF THE DRAWINGS

FIG. 12 is a diagram depicting a schematic relation among an operation velocity Vfx, a dragging velocity Vu, a dragging ratio ε, and a correction amount θ, in the embodiment of the present invention.

MODES FOR CARRYING OUT THE INVENTION

Figure 1:
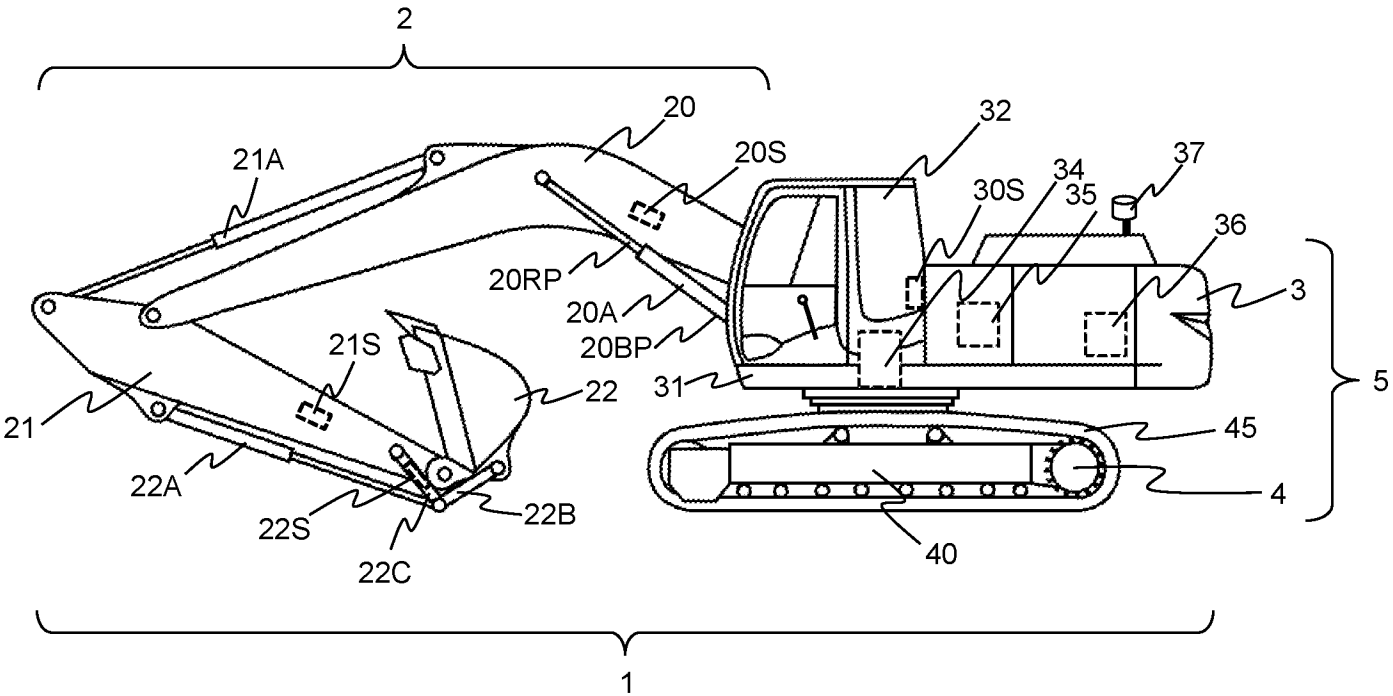
FIG. 1 is a side view of a hydraulic excavator (work machine) according to an embodiment of the present invention.

An embodiment of the present invention will be described below referring to the drawings.

<Object Device>

As illustrated in FIG. 1, a hydraulic excavator (work machine) 1 according to the present embodiment includes a machine body 5 having a track structure 4 and a swing structure 3 attached to an upper portion thereof, and an articulated front work device 2 configured by connecting a plurality of front members 20, 21, and 22 and rotatably attached to the swing structure 3.

The swing structure 3 is attached to the track structure 4 swingably in the leftward and rightward directions, and is driven to swing by a swing hydraulic motor (not illustrated).

The front work device 2 includes a boom 20 whose base end side is rotatably connected to the swing structure 3, an arm 21 whose base end side is rotatably connected to a tip end side of the boom 20, a bucket 22 whose base end side is rotatably connected to a tip end side of the arm 21, a boom cylinder 20A whose tip end side is connected to the boom 20 and whose base end side is connected to the swing structure 3, an arm cylinder 21A whose tip end side is connected to the arm 21 and whose base end side is connected to the swing structure 3, a first link member 22B whose tip end side is rotatably connected to the bucket 22, a second link member 22C whose tip end side is rotatably connected to a base end side of the first link member 22B, and a bucket cylinder 22A arranged bridgingly between a connection part of the two link members 22B and 22C and the arm 21. These hydraulic cylinders 20A, 21A, and 22A are configured to be rotatable in the vertical direction with respective connection parts as centers.

The boom cylinder 20A, the arm cylinder 21A, and the bucket cylinder 22A are structured to be capable of elongating and contracting by supplying and discharging a hydraulic working fluid delivered from a hydraulic pump 36*b* (see FIG. 2), and by elongating and contracting, can rotate (operate) the boom 20, the arm 21, and the bucket 22, respectively. The bucket 22 can be replaced optionally with an attachment, not illustrated, such as a grapple, a breaker, a ripper, or a magnet.

An inertia measuring unit sensor (hereinafter referred to as IMU sensor) (boom) 20S for detecting the posture of the boom 20 is attached to the boom 20, and an IMU sensor (arm) 21S for detecting the posture of the arm 21 is attached to the arm 21. An IMU sensor (bucket) 22S for detecting the posture of the bucket 22 is attached to the second link member 22C. The IMU sensor (boom) 20S, the IMU sensor (arm) 21S, and the IMU sensor (bucket) 22S each include an angular velocity sensor and an acceleration sensor, and are capable of detecting inclination angles, angular velocities, and accelerations of the front members 20, 21, and 22, respectively.

The swing structure 3 has a main frame 31. An IMU sensor (swing structure) 30S for detecting the inclination angle of the swing structure 30, a cab 32 in which an operator rides, a main controller (drive control controller) 34 that controls the driving of a plurality of hydraulic actuators in the hydraulic excavator 1, a prime mover device 36 having an engine 36*a* and the hydraulic pump 36*b* driven by the engine 36*a*, a hydraulic pressure controller 35 having a plurality of directional control valves 35*b* for controlling a flow rate and a flow direction of a hydraulic working fluid (hydraulic fluid) supplied from the hydraulic pump 36*b* to the hydraulic actuators (for example, the hydraulic cylinders 20A, 21A, and 22A) according to signals from the main controller 34, and a distance measuring sensor (machine body state sensor) 37 for detecting a movement velocity of the machine body 5 in a gravity coordinate system (also called a geographic coordinate system, a global coordinate system, or the like) set on the ground, are mounted on the main frame 31.

The IMU sensor (swing structure) 30S includes an acceleration sensor and an angular velocity sensor, and is capable of detecting the inclination (inclination angle) of the swing structure 3 relative to a horizontal plane, the angular velocity and the acceleration of the swing structure 3.

The cab 32 is provided with an operation input device 33 for the operator to input an operation, a target surface management device 100 for setting and storing construction target surface data defining a completed shape of a terrain profile, and a monitor (display device) 110 on which to display various kinds of information concerning the hydraulic excavator 1.

The operation input device 33 includes two operation levers 33*a* (unified into one in the illustration) for instructing the front work device 2 (the boom 20, the arm 21, the bucket 22) on rotational operations and instructing the swing structure 3*a* on a swing operation according to the operator's operation, two traveling operation levers 33*c* (unified into one in the illustration) for instructing left and right crawlers 45 of the track structure 4 on a traveling operation according to the operator' operation, and a plurality of operation sensors 33*b* (unified into one in the illustration) for detecting tilted amounts (operation amounts) of the operation levers 33*a* and 33*c*. The plurality of operation sensors 33*b* detect the amounts by which the operator tilts the four operation levers 33*a* and 33*c*, whereby the operation velocities the operator demands of the front members 20, 21, and 22 and the swing structure 3 and the track structure 4 are converted into electrical signals (operation signals) and outputted to the main controller 34. Note that the operation input device 33 (operation levers 33*a* and 33*b*) may be of a hydraulic pilot system in which a hydraulic working fluid adjusted to a pressure according to the operation amount is outputted as an operation signal. In that case, the operation sensor 33*b* is utilized as a pressure sensor, and a signal detected by the pressure sensor is outputted to the main controller 34, to detect the operation amount.

The hydraulic pressure controller 35 includes a plurality of solenoid control valves 35*a* that generates a hydraulic working fluid (pilot pressure) of a pressure according to the operation command value (command current) outputted from the main controller 34, and a plurality of directional control valves 35*b* that each are driven by the hydraulic working fluid (pilot pressure) outputted from the corresponding solenoid control valve 35*a* and control each of the flow rates and flow directions of the hydraulic working fluid supplied to the plurality of hydraulic actuators mounted on the hydraulic excavator 1. The operation command value outputted from the controller 34 is generated based on the operator's operation inputted to the operation levers 33*a* and 33*b*, but, when the area restriction control described later is functioning, an operation command value concerning the hydraulic actuator without an operator's operation may also be generated according to the conditions thereof. When an operation command value is outputted from the main controller 34 to the solenoid control valve 35*a*, the corresponding directional control valve 35*b* is operated, and the hydraulic actuator (for example, the hydraulic cylinder 20A, 21A, or 22A) corresponding to the directional control valve 35*b* is operated. The hydraulic actuators may include those for driving an attachment or an apparatus other than the aforementioned components.

The prime mover device 36 includes the engine (prime mover) 36*a* and at least one hydraulic pump 36*b* driven by the engine 36*a*, and supplies a hydraulic fluid (hydraulic working fluid) necessary for driving three hydraulic motors for driving the hydraulic cylinders 20A, 21A, and 22A, the swing structure 3, and the track structure 4. The prime mover device 36 is not limited to this configuration, and other power source such as an electric pump may also be used.

The distance measuring sensor (machine body state sensor) 37 is a sensor that detects a distance from a freely selected position set on the ground to the machine body 5 (the swing structure 3 and the track structure 4) (namely, the position of the machine body 5 with the freely selected position as a reference), and, for example, a millimeter wave radar, a LIDAR (Light Detection and Ranging), a stereo camera, a total station, and the like can be utilized therefor. The distance (position) detected by the distance measuring sensor 37 is outputted to the main controller 34, which differentiates the inputted distance (position) with time, to calculate the movement velocity of the machine body 5 in the gravity coordinate system set on the ground. For measuring the movement velocity of the machine body 5, not only the calculation by differentiating the position data of the hydraulic excavator 1 as mentioned above, but also a method of integrating acceleration data acquired by the IMU sensor (swing structure) 30S, and a method of directly measuring the movement velocity of the machine body 5 by use of a velocity sensor such as a Doppler speedometer may be used. In addition, the movement velocity of the machine body 5 may be calculated by combining these methods.

The track structure 4 includes a track frame 40, and the left and right crawlers 45 attached to the track frame 40. The operator appropriately operates the two traveling operation levers 33*c*, adjusting the rotational velocities of the left and right track hydraulic motors (hydraulic actuators) for driving the left and right crawlers 45, and accordingly, the hydraulic excavator 1 can be traveled. The track structure 4 is not limited to the one that includes the crawlers 45, and may be one that includes running wheels or legs (outrigger).

<System Configuration>

Figure 2:
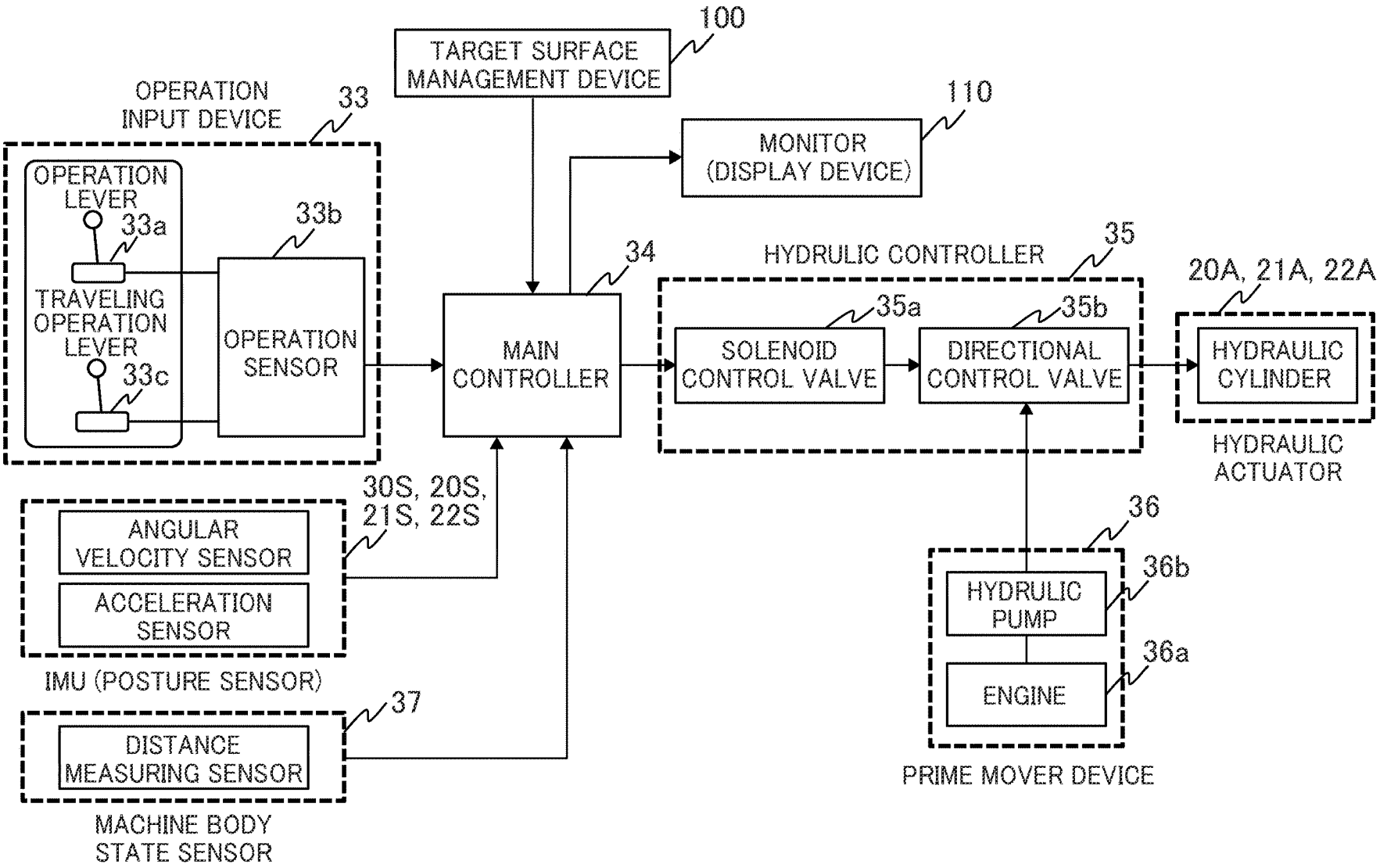
FIG. 2 is a diagram depicting a configuration of a control system according to the embodiment of the present invention.

FIG. 2 is a system configuration diagram of a hydraulic control system mounted on the hydraulic excavator 1 according to the present embodiment. Note that the parts described above may be appropriately omitted in description.

As depicted in this figure, the main controller 34 is electrically connected to the target surface management device (target surface management controller) 100, the monitor 110, the plurality of operation sensors 33*b*, the plurality of IMU sensors 30S, 20S, 21S, and 22S, the distance measuring sensor 37, and the plurality of solenoid control valves 35*a*, and is capable of establishing communication with them.

The target surface management device 100 is a device (for example, a controller (target surface management controller)) utilized for setting of a construction target surface (design surface) defining a completed shape of the terrain profile (working target) and storage of the position data of the set construction target surface (construction target surface data), and outputs the construction target surface data to the main controller 34. The construction target surface data are data defining a three-dimensional shape of the construction target surface, and, in the present embodiment, position information and angle information concerning the construction target surface are included therein. In the present embodiment, the position of the construction target surface is relative distance information relative to the swing structure 3 (hydraulic excavator 1) (namely, position data of the construction target surface in the coordinate system (machine body coordinate system) set on the swing structure 3 (hydraulic excavator 1)), and the angle of the construction target surface is defined as relative angle information relative to the gravity direction, but data obtained by appropriate conversion may be utilized, inclusive of a case where the position is the position coordinates on the earth (namely, the position coordinates in the gravity coordinate system) and a case where the angle is a relative angle to the machine body.

Note that it is sufficient for the target surface management device 100 to have a storing function for the preset construction target surface data, and, for example, the target surface management device 100 can also be replaced with a storage device such as a semiconductor memory. Therefore, when the construction target surface data are stored, for example, in a storage device in the main controller 34 or a storage device mounted on the hydraulic excavator, the target surface management device 100 can be omitted.

The monitor 110 is a display device capable of providing the operator with information such as the posture of the hydraulic excavator 1 (inclusive of the postures of the front work device 2 and the bucket 22), a distance and positional relation between the construction target surface and the bucket 22, and the like.

The main controller 34 is a controller that performs various control related to the hydraulic excavator 1. There are two characteristic controls which the main controller 34 of the present embodiment can execute.

First, the main controller 34 calculates a target velocity vector (for example, a target value of a velocity vector generated at the bucket claw tip) of the front work device 2 such that the position (working point) of the front work device 2 (for example, the claw tip of the bucket 22) is maintained on a predetermined construction target surface prescribed on the operation plane of the front work device 2 or above the upper side thereof while the operation lever 33*a* is operated by the operator (for example, while an arm operation is inputted), and calculates and outputs an operation command value for controlling at least one of the plurality of hydraulic cylinders 20A, 21A, and 22A such that the front work device 2 is operated according to the calculated target velocity vector, whereby the main controller 34 can execute an area restriction control. In other words, when, for example, the claw tip of the bucket 22 is selected as a working point in this area restriction control and the operator inputs an arm crowding operation, the work device 2 is semiautomatically controlled such that the bucket claw tip (bucket tip) is moved along the construction target surface, without specifically operating the other front member, and, therefore, excavation along the construction target surface can be performed regardless of the operator's skill. Hereinafter, a description will be continued, taking a case where the working point is set at the claw tip of the bucket 22 as an example.

Secondly, the main controller 34 calculates the operation velocity of the front work device 2 in the machine body coordinate system and the movement velocity of the machine body 5 in the gravity coordinate system. Based on the calculated operation velocity of the front work device 2 and the calculated movement velocity of the machine body 5, when occurrence of dragging during execution of the area restriction control (machine control) is detected, a treatment (dragging restraining control) of correcting the direction of the target velocity vector calculated for the area restriction control (machine control) upward away from the construction target surface can be performed.

Note that the operation plane of the front work device 2 is a plane on which each of the front members 20, 21, and 22 operates, namely, a plane orthogonal to all of the three front members 20, 21, and 22, and, of such planes, for example, a plane passing through the center in a width direction of the front work device 2 (the center in an axial direction of the boom pin which is a rotary shaft on the base end side of the boom 20) can be selected.

<Operation Input Device>

In general, in the hydraulic excavator, such a setting is made that the operation velocity of each hydraulic actuator increases as the tilted amount (tilting amount) of the operation levers 33*a* and 33*c* is increased. The operator changes the tilting amount of the operation levers 33*a* and 33*c* so as to change the operation velocity of each hydraulic actuator, thereby operating the hydraulic excavator 1.

The operation sensor 33*b* includes sensors for electrically detecting the operation amounts (tilting amounts) of the operation lever 33*a* for the boom 20, the arm 21, and the bucket 22 (the boom cylinder 20A, the arm cylinder 21A, the bucket cylinder 22A), and based on the detection signals of the operation sensor 33*b*, the operation velocities of the boom cylinder 20A, the arm cylinder 21A, and the bucket cylinder 22A required by the operator can be detected. The operation sensor is not limited to the one that directly detects the tilted amount of the operation levers 33*a* and 33*c* and may be of a system of detecting the pressure of a hydraulic working fluid (operation pilot pressure) outputted by an operation of the operation levers 33*a* and 33*c*.

<Posture Sensor>

The IMU sensor (swing structure) 30S, the IMU sensor (boom) 20S, the IMU sensor (arm) 21S and the IMU sensor (bucket) 22S each include an angular velocity sensor and an acceleration sensor. By these IMU sensors, an angular velocity and acceleration data at respective set positions can be obtained. Since the boom 20, the arm 21, the bucket 22, the boom cylinder 20A, the arm cylinder 21A, the bucket cylinder 22A, the first link member 22B, the second link member 22C, and the swing structure 3 are attached to be rotatable (swingable), the postures and positions in the machine body coordinate system of the boom 20, the arm 21, the bucket 22 and the swing structure 3 can be calculated from the sizes and mechanical link relations of the parts. Note that the detection method for posture and position described here is merely an example, and the relative angles of the parts of the front work device 2 may be directly measured, or the strokes of the boom cylinder 20A, the arm cylinder 21A, and the bucket cylinder 22A are detected and the postures and positions of the parts of the hydraulic excavator 1 may be calculated.

<Main Controller>

Figure 3:
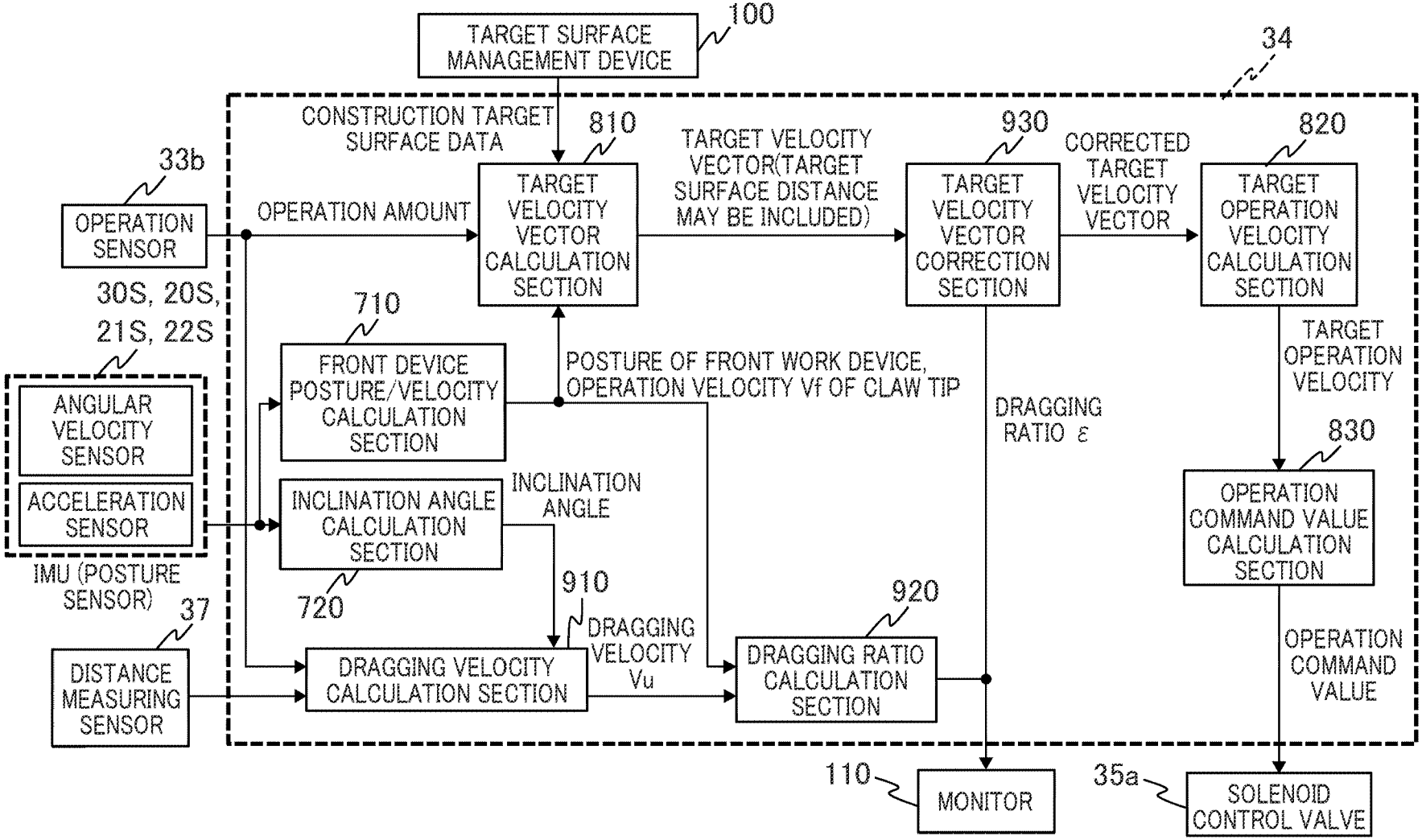
FIG. 3 is a diagram depicting a configuration (functional block diagram) of a main controller according to the embodiment of the present invention.

FIG. 3 is a configuration diagram of the main controller 34. The main controller 34 includes, for example, a hardware including a CPU (Central Processing Unit), a storage device such as a ROM (Read Only Memory) and an HDD (Hard Disk Drive) for storing various kinds of programs for executing processing by the CPU, and a RAM (Random Access Memory) serving as a working area when the CPU executes the programs. By thus executing the programs stored in the storage device, functions of a front device posture/velocity calculation section 710, an inclination angle calculation section 720, a target velocity vector calculation section 810, a target operation velocity calculation section 820, an operation command value calculation section 830, a dragging velocity calculation section 910, and a dragging ratio calculation section 920 are realized. Next, details of processing performed by each part will be described.

(Front Device Posture/Velocity Calculation Section 710)

The front device posture/velocity calculation section 710 calculates the postures of the boom 20, the arm 21, and the bucket 22 (front work device 2) in the machine body coordinate system and the operation velocity Vf (see FIG. 5) of the tip of the front work device 2 (claw tip of the bucket 22) in the machine body coordinate system, based on acceleration signals and angular velocity signals obtained from the IMU sensor (boom) 20S, the IMU sensor (arm) 21S, and the IMU sensor (bucket) 22S. The front device posture/velocity calculation section 710 outputs the calculated postures and calculated operation velocities to the target velocity vector calculation section 810 and the dragging ratio calculation section 920 as posture data and operation velocity data.

(Inclination Angle Calculation Section 720)

The inclination angle calculation section 720 calculates the inclination angle of the swing structure 3 relative to a predetermined plane (for example, a horizontal plane) based on a signal outputted by the IMU sensor (swing structure) 30S, and outputs the calculation result to the dragging velocity calculation section 910 as inclination angle data.

(Target Velocity Vector Calculation Section 810)

The target velocity vector calculation section 810 calculates a target velocity vector Vt (see FIG. 4) to be generated at a working point (bucket claw tip) such that the moving range of a freely selected point set on the front work device 2 (this point may be referred to as a "working point." In the present embodiment, the working point is set at the claw tip of the bucket 22) is maintained on the construction target surface or above an upper side of the construction target surface, based on posture data inputted from the front device posture/velocity calculation section 710, preliminarily stored size data of the front members 20, 21, and 22, operation amount data inputted from the operation sensor 33*b*, and construction target surface data (position data of the construction target surface) inputted from the target surface management device 100, and outputs the calculated target velocity vector Vt to the target velocity vector correction section 930 as target velocity vector data.

As a specific example of the calculation method for the target velocity vector Vt by the target velocity vector calculation section 810, there is a method in which a component in a direction along the construction target surface of the target velocity vector Vt is determined based on an arm operation amount, and a component in a direction perpendicular to the construction target surface of the target velocity vector is determined based on the distance (target surface distance) between the bucket claw tip (working point) and the construction target surface. As a method different from this method, there is a method in which such a target velocity vector Vt that the velocity in the direction perpendicular to the construction target surface of the bucket claw tip becomes a value based on the distance (target surface distance) between the bucket claw tip and the construction target surface, while the arm 21 is operated according to the operation amount, is determined.

Figure 4:
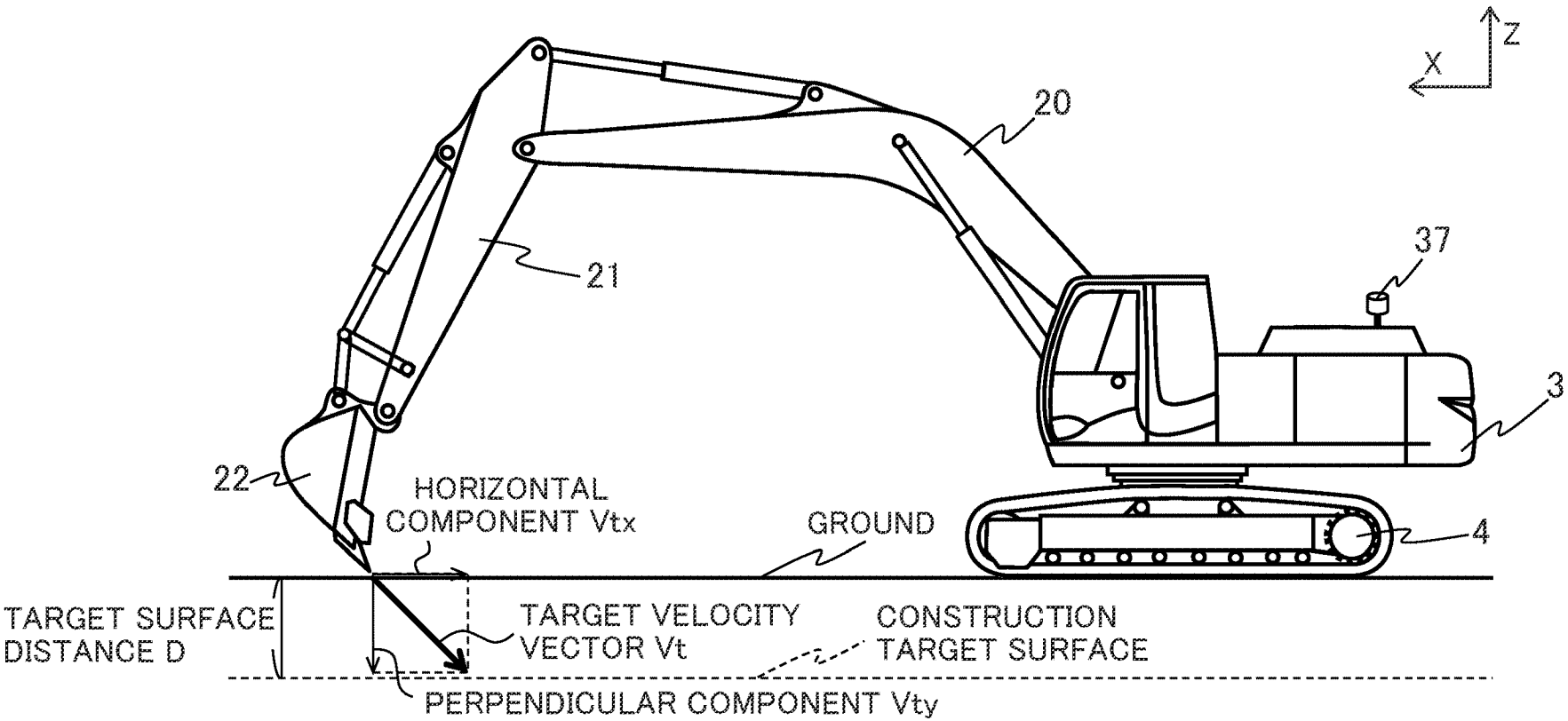
FIG. 4 is an explanatory view of a target velocity vector Vt of the hydraulic excavator according to the embodiment of the present invention.

Here, one example of the former method will be described in detail using FIG. 4. First, (1) a velocity vector generated in the bucket claw tip (working point) by an arm operation is calculated based on the arm operation amount included in the operation amount data, and the component in the direction along the construction target surface of the calculated velocity vector is made to be a velocity component (horizontal component Vtx) in the direction along the construction target surface of the target velocity vector. (2) The distance between the bucket claw tip and the construction target surface (target surface distance D) is calculated based on the posture data and the construction target surface data, and the velocity component (perpendicular component Vty) in the direction perpendicular to the construction target surface of the target velocity vector is calculated based on the target surface distance D. It is to be noted, however, that a relation between the target surface distance D and the perpendicular component Vty is preliminarily determined. Specifically, a relation is preliminarily set such that the perpendicular component Vty is also zero when the target surface distance D is zero, and as the target surface distance D increases from zero, the magnitude of the perpendicular component Vty (this component has a downward direction with the construction target surface as a reference) is also monotonously increased. (3) The two velocity components Vtx and Vty calculated in (1) and (2) above are added to obtain a target velocity vector Vt. In this case, when the operation amount for the arm 21 by the operator is large, the target velocity vector Vt becomes large, and when the target surface distance D is small, the target velocity vector Vt becomes only the direction parallel to the construction target surface (horizontal component). When the target velocity vector Vt is thus calculated, the moving range of the bucket claw tip is maintained on the construction target surface or above the upper side of the construction target surface. Particularly when the bucket claw tip is located on the construction target surface (when the target surface distance is zero), the perpendicular component is maintained at zero and only the horizontal component exists, and, accordingly, the bucket claw tip can be moved along the construction target surface by only operating the arm 21, for example.

Note that, when the target velocity vector correction section 930 utilizes the target surface distance calculated by the target velocity vector calculation section 810 for correction of the target velocity vector (proportional constant K) as FIG. 9 described later, the target velocity vector calculation section 810 may output the data (target surface distance data) to the target velocity vector correction section 930.

(Dragging Velocity Calculation Section 910)

Based on data (distance data) acquired from the distance measuring sensor 37 (machine state sensor), the dragging velocity calculation section 910 calculates the movement velocity (dragging velocity) Vu of the machine body 5 in the gravity coordinate system when the machine body 5 (the swing structure 3 and the track structure 4) moves toward the front work device 2 when dragging is generated. Note that, since the swing structure 3 is attached to the track structure 4 to be swingable only in leftward and rightward directions, the dragging velocities of the swing structure 3 and the track structure 4 coincide with each other.

When the distance measuring sensor 37 is utilized as the machine body state sensor, the relative position (namely, distance) of the swing structure 3 relative to a specific point in the periphery of the hydraulic excavator 1 is measured periodically, and, by differentiating the measurement result with time, the movement velocity Vu of the machine body 5 can be calculated. Other than this, a method of calculating the movement velocity Vu by integrating acceleration information of the IMU sensor (swing structure) 30S may be used, a method of directly measuring the operation velocity Vu of the swing structure 3 by use of a velocity sensor such as a Doppler speedometer may be used, and a method of calculating the movement velocity Vu by integrating with time the positioning results of receivers (for example, global navigation satellite system receivers) for receiving the positioning signals from a plurality of positioning satellites with an antenna mounted to the swing structure 3 and measuring the position of the machine body 5 (swing structure 3) based on the positioning signals may be used. In addition, by combining these method, the movement velocity Vu of the swing structure 3 and the track structure 4 may be measured more accurately.

(Measuring Method for Dragging Velocity)

Figure 5:
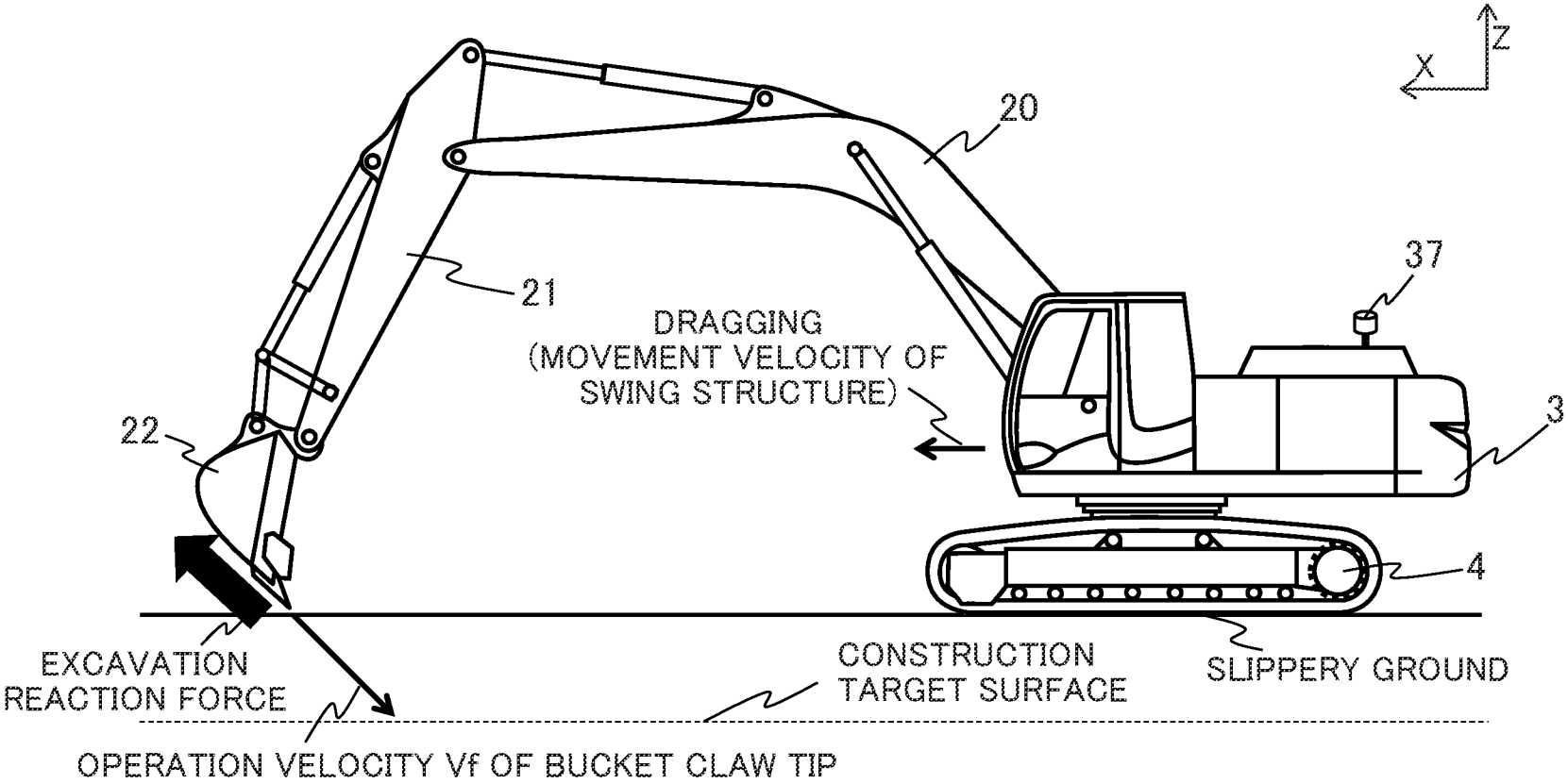
FIG. 5 is an explanatory view of dragging which may occur in the hydraulic excavator according to the embodiment of the present invention.
Figure 6:
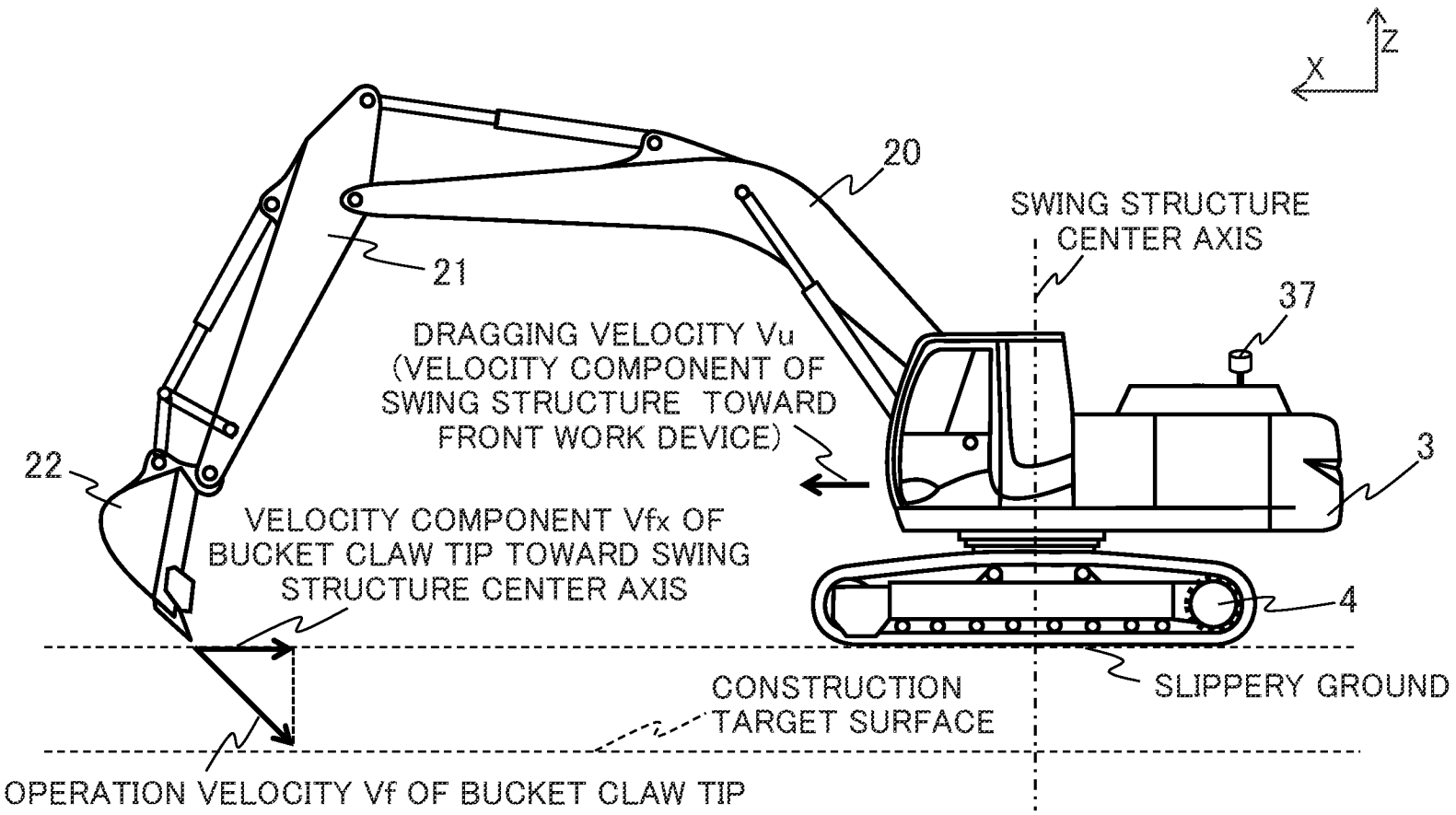
FIG. 6 is an explanatory view of a dragging velocity of the hydraulic excavator according to the embodiment of the present invention, viewed from a lateral side of the hydraulic excavator.
Figure 7:
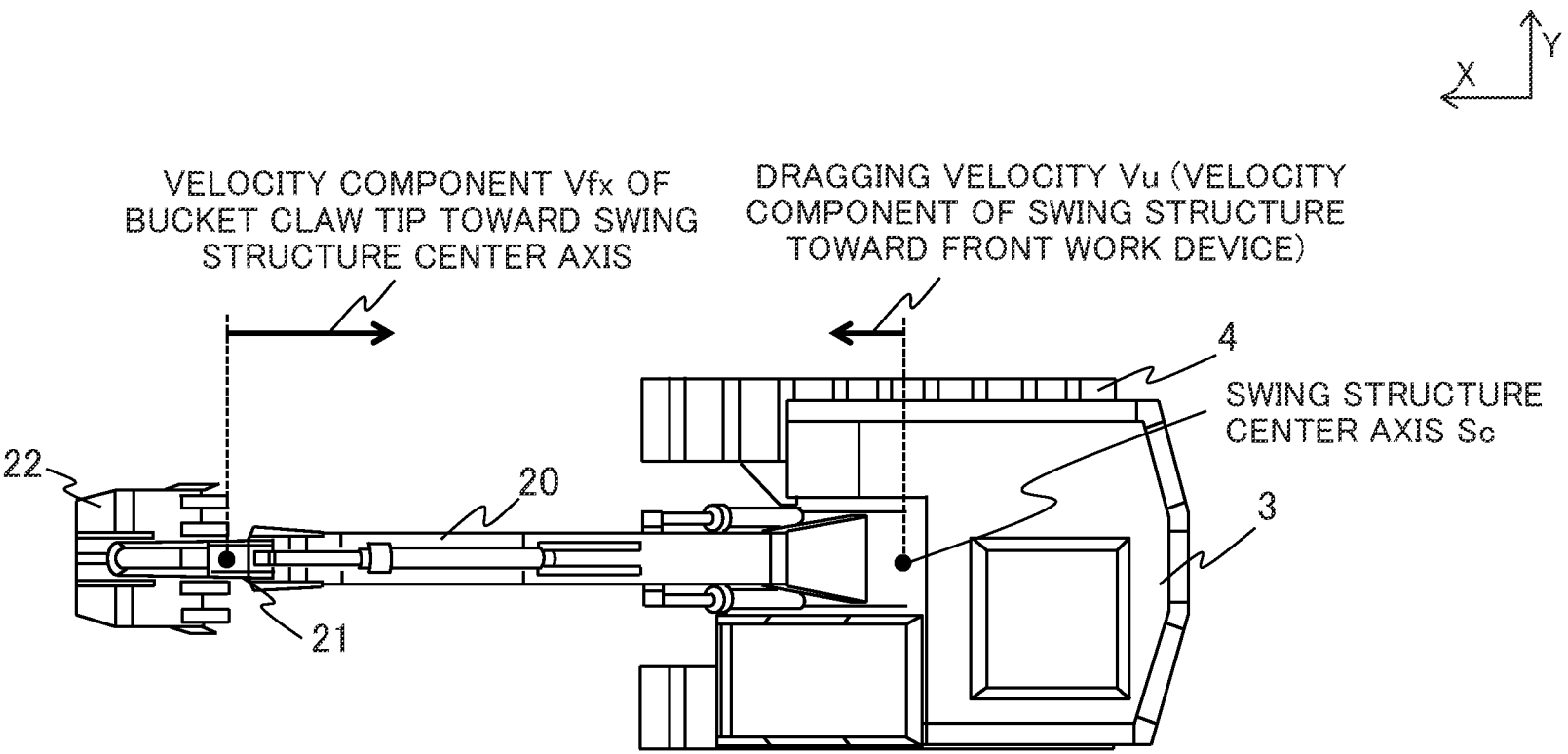
FIG. 7 is an explanatory view of the dragging velocity of the hydraulic excavator according to the embodiment of the present invention, viewed from an upper side of the hydraulic excavator.

The dragging velocity will be described using FIGS. 5 to 7. When the front work device 2 is driven to excavate as depicted in FIG. 5, the swing structure 3 may be dragged in the direction of the front work device 2 due to excavation reaction force from the ground. The velocity component of movement of the swing structure 3 in the direction of the front work device 2 (the velocity component along the front-rear direction of the swing structure 3) is calculated as a dragging velocity Vu by use of the detection value of the distance measuring sensor 37. The dragging velocity Vu mentioned here is a velocity component of a swing center axis Sc toward the front work device 2 as the hydraulic excavator 1 is viewed from the upper side (upper surface) as depicted in FIG. 7, and indicates a velocity component of the swing structure 3 toward the front work device 2 in parallel to the ground surface (plane) on which the track structure 4 is mounted as the hydraulic excavator 1 is viewed from a lateral side (side surface) as depicted in FIG. 6.

It is to be noted, however, that, when the hydraulic excavator 1 is self-propelling by driving the track structure 4, the dragging velocity calculation section 910 takes the dragging velocity Vu as zero, since dragging is not generated. Whether or not the track structure 4 is self-propelling can be determined, for example, from the presence or absence of an operation input to the traveling operation lever 33*c* (namely, an output signal of the operation sensor 33*b*).

Note that, when the ground surface on which the track structure 4 is mounted is inclined relative to a horizontal plane, the dragging velocity calculation section 910 inputs inclination angle data calculated from an output signal of the IMU sensor (swing structure) 30S, and calculates the dragging velocity Vu by taking the inclination angle into account. Specifically, from the movement velocity of the swing structure 3 in the gravity coordinate system calculated by utilizing the distance measuring sensor 37, the velocity component parallel to the front-rear direction (X-axis) in the machine body coordinate system of the movement velocity is calculated by utilizing the inclination angle, and the velocity component is set as the dragging velocity Vu.

(Dragging Ratio Calculation Section 920)

The dragging ratio calculation section 920 calculates the ratio of the movement velocity (dragging velocity) of the machine body 5 relative to the operation velocity of the tip (bucket claw tip) of the front work device 2 as a dragging ratio ε, based on the operation velocity data outputted from the front device posture/velocity calculation section 710 and the dragging velocity data outputted from the dragging velocity calculation section 910, and outputs the calculated dragging ratio ε as dragging ratio data to the target velocity vector correction section 930 and the monitor 110.

It is to be noted, however, that, in calculating the dragging ratio ε, it is preferable to align the operation velocity of the tip end of the front work device 2 and the movement velocity (dragging velocity) of the machine body 5 in the same direction. Though the details will be described later, in the present embodiment, as depicted in FIGS. 6 and 7, both the velocities (the operation velocity of the tip end of the front work device 2 and the movement velocity of the machine body 5) are aligned in the direction of a straight line orthogonal to the swing structure center axis and extending in the front-rear direction of the swing structure 3 (the X-axis direction in the machine body coordinate system), and the dragging ratio is calculated by utilizing the horizontal component Vfx of the operation velocity Vf of the tip end of the front work device 2.

(Calculating Method for Dragging Ratio)

As depicted in FIGS. 6 and 7, in regard to the operation velocity Vf of the tip end (bucket claw tip) of the front work device 2, when the velocity component (horizontal component) toward the swing center axis of the swing structure 3 is Vfx, the dragging ratio is represented by the following formula, utilizing Vfx and Vu.

[Math. 1]

$$\varepsilon = -Vu/Vfx \qquad \text{Formula (1)}$$

When the dragging ratio ε is zero (namely, when the dragging velocity Vu is zero), dragging is not generated, and a status in which excavation by the bucket 22 can be realized is indicated. On the other hand, when the dragging ratio ε is not zero (larger than zero), a status in which dragging is generated is indicated. It is to be noted, however, that, when the dragging ratio ε is 1, a status in which the hydraulic excavator 1 is perfectly dragged and excavation by the bucket 22 cannot be realized is indicated. Note that Vfx and Vu are different in positive and negative signs as depicted in FIGS. 6 and 7, and in Formula (1), a minus sign is added to the ratio of Vfx and Vu, since the dragging ratio ε should desirably be a value equal to or larger than zero.

(Target Velocity Vector Correction Section 930)

The target velocity vector correction section 930 corrects the target velocity vector according to the dragging ratio ε, and calculates a target velocity vector after correction, based on the dragging ratio data outputted from the dragging ratio calculation section 920 and the target velocity vector data outputted from the target velocity vector calculation section 810. The target velocity vector correction section 930 calculates the target velocity vector after correction by correcting the direction of the target velocity vector upward away from the construction target surface, and outputs the calculated target velocity vector data after correction to the target operation velocity calculation section 820. Next, the details of the correcting method for the target velocity vector will be described.

(Correcting Method for Target Velocity Vector)

As aforementioned, the dragging of the hydraulic excavator 1 is generated due to the fact that the excavation reaction force in the direction of being dragged is greater than the pulling force of the track structure 4. In view of this, in the present embodiment, for lowering the possibility of generation of dragging, the target velocity vector is corrected such that the excavation reaction force of the front work device 2 is reduced.

In the present embodiment, the target velocity vector is corrected by rotating the target velocity vector calculated by the target velocity vector calculation section 810 according to the magnitude of the dragging ratio ε. Here, when the target velocity vector is $[X\ Z]^T$ (the suffix T on the right upper side (superscript) indicates a transposed matrix), the target velocity vector $[X'\ Z']^T$ after correction is represented by the following formula (2).

[Math. 2]

$$\begin{bmatrix} X' \\ Z' \end{bmatrix} = \begin{bmatrix} \cos\theta & -\sin\theta \\ \sin\theta & \cos\theta \end{bmatrix} \begin{bmatrix} X \\ Z \end{bmatrix} \qquad \text{Formula (2)}$$

It is to be noted, however, that θ represents the rotational angle (correction amount) of the target velocity vector by correction, and is defined by the following formula (3) using the proportional constant K.

[Math. 3]

$$\theta = K\varepsilon \quad \text{Formula (3)}$$

In other words, the target velocity vector calculation section 810 calculates the rotational angle (correction amount) of the target velocity vector based on the dragging ratio ε, and a relation between the dragging ratio ε and the correction amount (rotational angle θ) of the target velocity vector prescribed by the above formula (3) is a monotonous increase relation in which the rotational angle θ increases with an increase in the dragging ratio ε. Note that this monotonous increase relation may include a section of monotonous non-decrease in which the rotational angle θ is not reduced but is held at a predetermined value even if the dragging ratio ε increases.

The proportional constant K may be preliminarily determined by an experiment or the like, or may be settable by the operator according to the working environment of the hydraulic excavator 1.

(Correction Example of Target Velocity Vector)

A correction example of the target velocity vector will be described using FIG. 8. When the dragging ratio ε is zero, dragging is not generated, so that the rotational angle θ becomes zero from Formula (3), and the target velocity vector is not corrected as FIG. 8(*a*).

Figure 8:
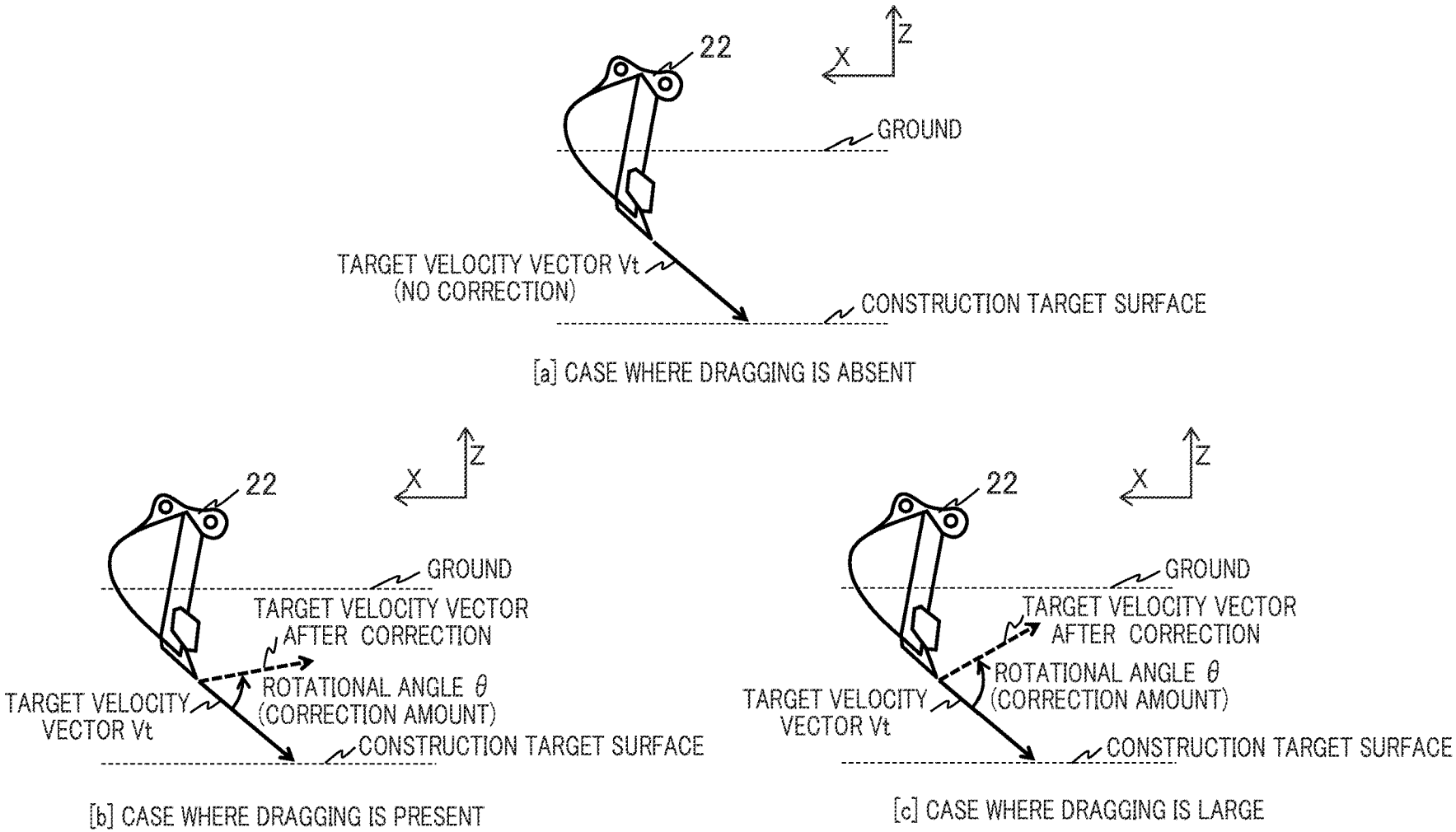
FIG. 8 is an explanatory view depicting a correction method for a target velocity vector of a front work device according to the embodiment of the present invention.

When the dragging ratio ε is not zero, dragging is generated, so that the target velocity vector is corrected as FIG. 8(*b*), based on the rotational angle θ calculated from Formula (3) and the dragging ratio ε. In other words, the target velocity vector is rotated by θ upward away from the construction target surface with the bucket claw tip as a center, and the vector after the rotation is used as the target velocity vector after correction.

When the dragging ratio ε is further larger than the state of FIG. 8(*b*), the rotational angle θ is enlarged as FIG. 8(*c*), and the target velocity vector is corrected (rotated) more largely than the case of FIG. 8(*b*).

Note that, in the examples of FIG. 8(*b*) and FIG. 8(*c*), in both cases, the rotational angle θ is added such that the component (perpendicular component) in the Z-axis direction perpendicular to the construction target surface of the target velocity vector after correction is in an upward direction. In other words, while the perpendicular component of the target velocity vector Vt before correction is in a downward direction, this is modified into an upward direction by the correction. With the target velocity vector Vt corrected in this way, such an excavation reaction force as to generate dragging is not received, so that generation of dragging is rapidly resolved.

(Correction of Proportional Constant K)

Incidentally, when the distance (target surface distance) between the bucket 22 and the construction target surface is comparatively small or when the magnitude of the target velocity vector is comparatively small (namely, when the operation amount of the operation lever 33*a* is comparatively small), a finishing work for causing the shape of the excavated surface to become the shape of the construction target surface is highly possibly performed, so that it is preferable to perform a finishing area restriction control of reducing ruggedness of the excavated surface and smoothly finishing the excavated surface. In view of this, the proportional constant K in Formula (3) may be varied according to the magnitudes of the target surface distance and the target velocity vector.

Figure 9:
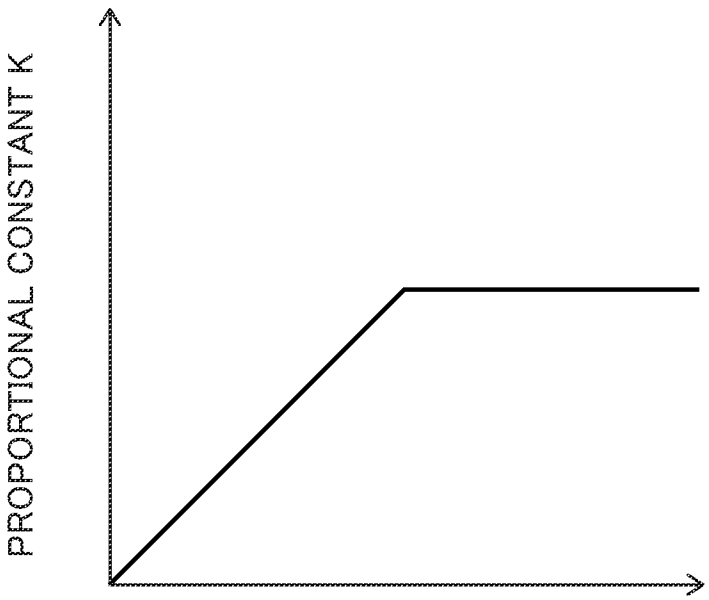
FIG. 9 is an explanatory view depicting a correction method for a proportional constant of the front work device according to the embodiment of the present invention.
Figure 9:
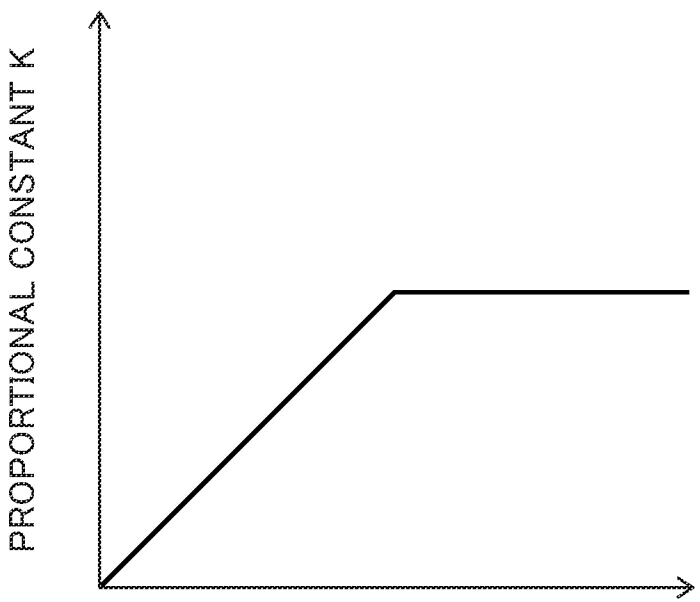

FIG. 9 is a diagram depicting an example of variation in the proportional constant K according to the magnitudes of the target surface distance and the target velocity vector. In FIG. 9(*a*), the target velocity vector calculation section 810 calculates the proportional constant K (in other words, the correction amount (rotational angle θ) of the target velocity vector) based on the target surface distance, and a relation between the target surface distance and the proportional constant K (namely, the rotational angle θ) prescribed by the function of FIG. 9(*a*) is a monotonous increase relation in which the proportional constant K (namely, the rotational angle θ) increases with an increase in the target surface distance. Note that this monotonous increase relation may include a section of monotonous non-decrease in which the proportional constant K (rotational angle θ) is not reduced but is held at a predetermined value even if the target surface distance increases.

In FIG. 9(*b*), the target velocity vector calculation section 810 calculates the proportional constant K (in other words, the correction amount (rotational angle θ) of the target velocity vector) based on the magnitude (scalar) of the target velocity vector, and a relation between the magnitude of the target velocity vector and the proportional constant K (namely, the rotational angle θ) prescribed by the function of FIG. 9(*b*) is a monotonous increase relation in which the proportional constant K (namely, the rotational angle θ) increases with an increase in the magnitude of the target velocity vector. Note that this monotonous increase relation may include a section of monotonous non-decrease in which the proportional constant K (rotational angle θ) is not reduced but is held at a predetermined value even if the magnitude of the target velocity vector increases as depicted in FIG. 9(*b*).

(Target Operation Velocity Calculation Section 820)

The target operation velocity calculation section 820 calculates, by kinematical calculation, target operation velocities (target actuator velocities) of the boom cylinder 20A, the arm cylinder 21A, and the bucket cylinder 22A necessary for generating the target velocity which is a velocity at the working point (bucket claw tip) at the bucket claw tip, based on the size data, the posture data, and the target velocity data. The target operation velocity calculation section 820 outputs the calculated target operation velocity to the operation command value calculation section 830 as target operation velocity data. Note that the target operation velocities of the boom cylinder 20A, the arm cylinder 21A, and the bucket cylinder 22A may be referred to respectively as boom velocity, arm velocity, and bucket velocity.

(Operation Command Value Calculation Section 830)

The operation command value calculation section 830 generates an operation command value necessary for driving each solenoid control valve 35*a*, according to the target operation velocities of the boom cylinder 20A, the arm cylinder 21A, and the bucket cylinder 22A calculated by the target operation velocity calculation section 820, and outputs the generated operation command value to the corresponding solenoid control valve 35*a*, thereby driving the corresponding directional control valve (control valve) 35*b*.

<Monitor>

The monitor 110 is a display device capable of displaying the posture of the hydraulic excavator 1 (namely, the postures of the front work device 2 and the machine body 5), the distance (target surface distance) between the construction target surface and the bucket 22, the current triggering state of machine control (the presence or absence of execution of dragging restraining control) and the like.

(Displayed Image)

Figure 10:
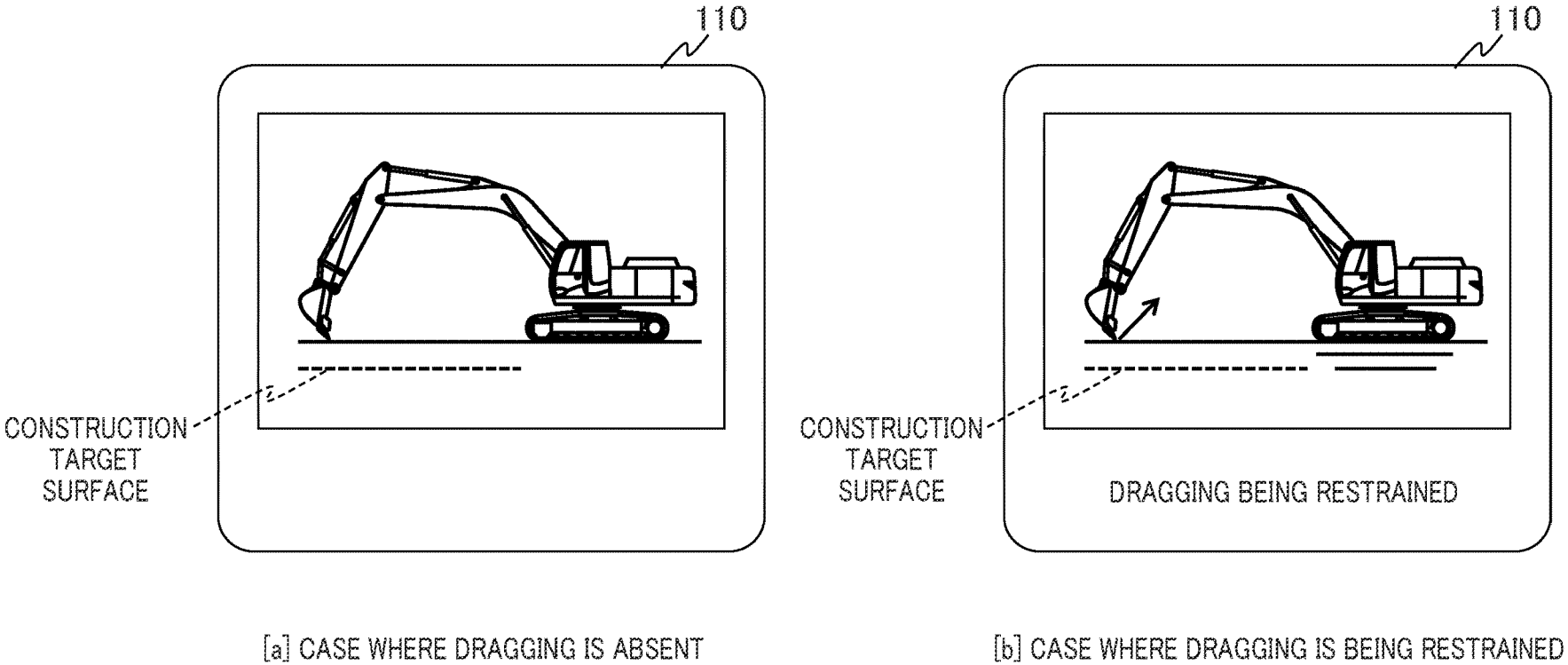
FIG. 10 is a diagram depicting an example of a display screen of a monitor according to the embodiment of the present invention.

In the monitor 110 in the present embodiment, when generation of dragging of the machine body 5 is absent, an image schematically resembling the hydraulic excavator 1 and the construction target surface are displayed as depicted in FIG. 10(*a*). Note that the target surface distance may be displayed in numerical value on this screen.

On the other hand, when a control (dragging restraining control) for restraining generation of dragging is triggered by correcting (rotating) the target velocity vector while excavation is conducted by utilizing area restriction control, a state in which the target velocity vector is corrected and a control different from the area restriction control is being conducted can be displayed on the monitor 110, by use of characters ("dragging being restrained") or figures. The operator, looking at this display, can recognize that a dragging restraining control is being conducted in priority over an area restriction control for the front work device 2, whereby the degree of discomfort generated due to the difference of the operation of the front work device 2 from the operator's own recognition can be reduced.

<Control Sequence of Main Controller>

Figure 11:
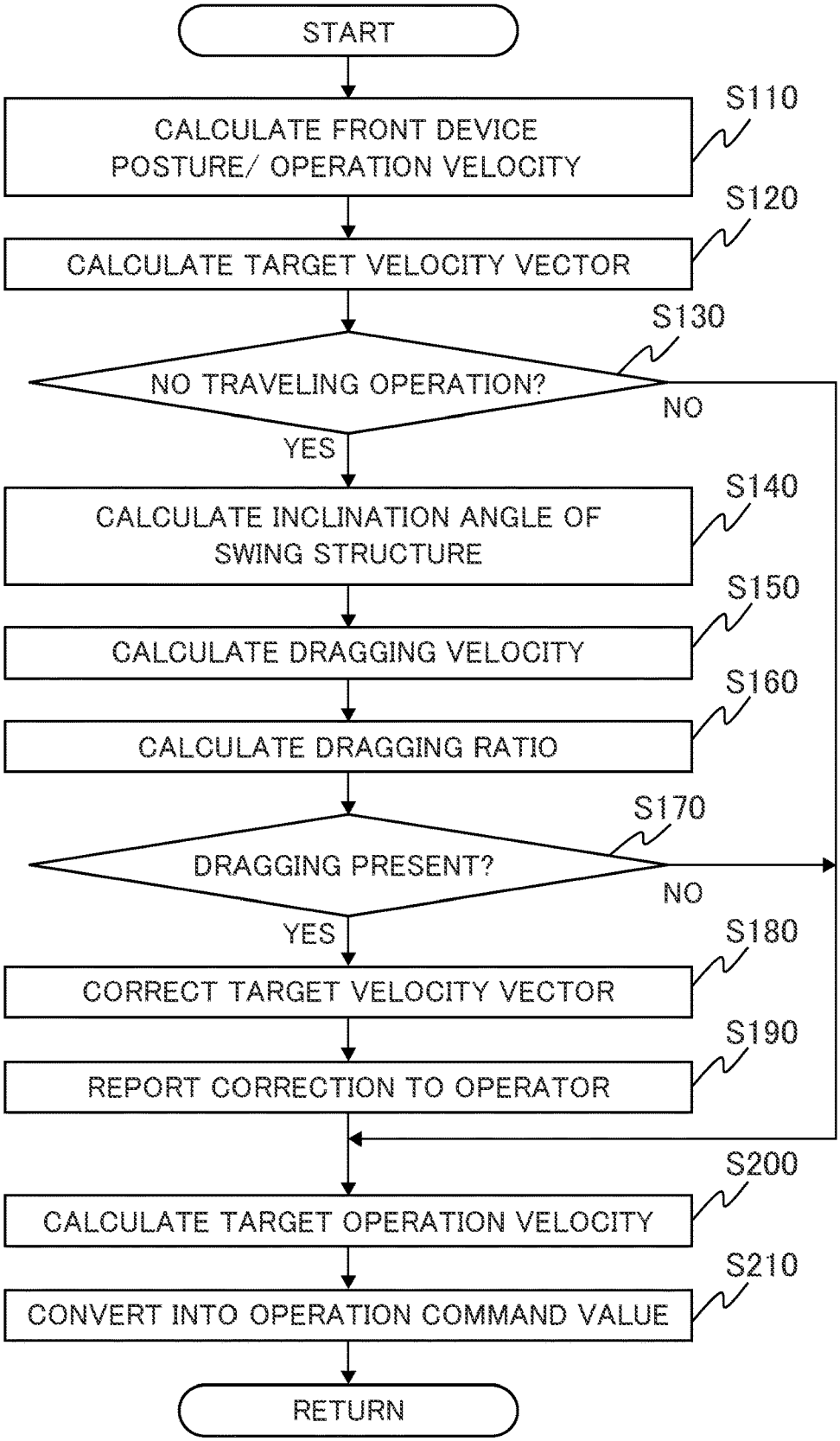
FIG. 11 is a flow chart depicting a control procedure of the main controller according to the embodiment of the present invention.

FIG. 11 is a flow chart of processes executed by the main controller 34, explaining the flow of calculations by each of the sections described in the main controller 34 in FIG. 3. Hereinafter, each of the processes (steps S110 to S210) may be described with each of the sections in the main controller 34 depicted in FIG. 3 as a subject, but the hardware executing each process is the main controller 34. In addition, a detailed explanation of the process of each section may be described at the explanation of each section.

In step S110, the front device posture/velocity calculation section 710 calculates the posture (front device posture) of the boom 20, the arm 21, and the bucket 22 in the machine body coordinate system and the operation velocity Vf (see FIG. 5) of the tip end (the claw tip of the bucket 22) of the front work device 2 in the machine body coordinate system.

In step S120, the target velocity vector calculation section 810 calculates a target velocity vector Vt (see FIG. 4) to be generated at the working point (in the present embodiment, the claw tip of the bucket 22) set on the front work device 2, such that the moving range of the working point (bucket claw tip) is held on the construction target surface or above the upper side of the construction target surface, based on posture data, size data, operation amount data, and construction target surface data.

In step S130, the dragging velocity calculation section 910 determines whether or not an operation (traveling operation) for self-propelling of the track structure 4 is inputted to the operation lever 33*c*, based on an output signal from the operation sensor 33*b*. Here, when it is determined that the traveling operation is not inputted (when self-propelling of the track structure 4 is absent), the control proceeds to step S140. On the other hand, when it is determined that the traveling operation is performed, the dragging velocity Vu is calculated to be zero, and the control proceeds to step S200.

In step S140, the inclination angle calculation section 720 calculates the inclination angle of the machine body 5 (the swing structure 3 and the track structure 4), based on an output signal of the IMU sensor (swing structure) 30S.

In step S150, the dragging velocity calculation section 910 calculates the velocity (dragging velocity) Vu at which the machine body 5 is moved toward the front work device 2 being dragged by the operation of the front work device 2 at a time of generation of dragging, based on the data (distance data) acquired from the distance measuring sensor 37 and the inclination angle of the machine body 5 calculated in step S140.

In step S160, the dragging ratio calculation section 920 calculates the dragging ratio ε which is the ratio of the movement velocity (dragging velocity) Vu of the machine body 5 relative to the horizontal component (Vfx) of the operation velocity of the tip end (bucket craw tip) of the front work device 2, based on the operation velocity Vf calculated in step S110 and the dragging velocity Vu calculated in step S150.

In step S170, the dragging ratio calculation section 920 determines whether or not dragging is generated from the dragging ratio ε calculated in step S160. When the dragging ratio ε here is greater than zero and it is determined that dragging is generated, the control proceeds to step S180. On the other hand, when the dragging ratio ε is zero and it is determined that dragging is not generated, the control proceeds to step S200.

In step S180 (when dragging is present), the target velocity vector correction section 930 calculates a correction amount θ for the target velocity vector Vt, by use of the dragging ratio ε calculated in step S160 and the above formula (3). In that instance, the proportional constant K in Formula (3) may be corrected, according to the magnitudes of the target surface distance and the target velocity vector Vt as above-described.

In step S190, the main controller 34 displays on the monitor 110 that dragging generation restraining control is performed, thereby reporting to the operator that the target velocity vector is to be corrected.

In step S200, the target operation velocity calculation section 820 calculates target operation velocities for driving the hydraulic cylinders 20A, 21A, and 22A of the front work device 2, according to the target velocity vector calculated in step S120 when is determined that generation of dragging is absent and according to the target velocity vector corrected in step S180 when it is determined that generation of dragging is present.

In step S210, an operation command value is calculated according to the target operation velocity calculated in step S200, and outputs the operation command signal to the solenoid control valve 35*a* corresponding to the operation command signal. As a result, the front work device 2 is semiautomatically operated according to the target velocity vector, and area restriction control or dragging restraining control is performed.

<Advantageous Effects>

(1) In the hydraulic excavator 1 according to the present embodiment configured as above-described, when dragging is generated while area restriction control based on the arm operation by the operator is performed, the main controller 34 corrects the direction of the target velocity vector Vt for the area restriction control upward away from the construction target surface (for example, as depicted in FIG. 8, the target velocity vector is rotated until the direction of the velocity component perpendicular to the construction target surface of the target velocity vector after correction becomes at least upward). As a result, the magnitude of the dragging reaction force is reduced as that compared to before the target velocity vector is corrected, so that generation of dragging can be prevented. In that instance, although the magnitude of the velocity component parallel to the construction target surface of the target velocity vector after correction may possibly vary from the magnitude of the same velocity component before the correction, the velocity component parallel to the construction target surface is left, so that the operation (for example, an excavating operation) of the arm cylinder 21A can be continued. In other words, according to the present embodiment, generation of dragging of the machine body 5 can be prevented without stopping the arm cylinder 21A during triggering of area restriction control, and, therefore, the operator's operability and workability can be restrained from being lowered.

(2) In the present embodiment, the dragging ratio ε which is a ratio of the movement velocity (dragging velocity) Vu of the machine body 5 based on the operation velocity of the front work device 2 is calculated, and the correction amount (rotational angle θ) of the target velocity vector is determined based on the magnitude of the dragging ratio ε. Here, the dragging ratio ε is an index capable of expressing a relation between a machine body pulling force (slipperiness) and an excavation load on a pseudo basis, so that the excavation load can be reduced according to the state of the machine body pulling force and generation of dragging can be suitably prevented, as compared to, for example, a case where the correction amount of the target velocity vector Vt is determined based on only the magnitude of the dragging velocity Vu. This point will be supplemented using FIG. 12.

FIG. 12 is a diagram schematically depicting the magnitude of dragging ratio ε and the magnitude of the correction amount (rotational angle θ) necessary in each case, in a total of three patterns of cases (states 1-3) in which the horizontal component Vfx of the operation velocity of the front work device 2 and the dragging velocity Vu are respectively fast and slow.

First, when the excavation load on the bucket 22 is large or the machine body 5 is slippery (state 2 or 3), dragging is not eliminated unless the excavation load is reduced largely, so that the target velocity vector Vt should be corrected largely upward. In the present embodiment, the dragging ratio ε calculated in these cases is large, and the correction amount θ is also calculated to be large along with the increase of the dragging ratio ε. In other words, the correction amount coincides with the correction amount required in each state, so that generation of dragging can be eliminated suitably.

On the other hand, when the excavation load on the bucket 22 is medium or when the machine body 5 is less liable to be slippery (state 1), the excavation load is sufficiently reduced by only correcting the target velocity vector Vt slightly upward, so that dragging is eliminated. In the present embodiment, the dragging ratio ε calculated in this case is small, and the correction amount θ is also calculated to be small along with the decreased dragging ratio. In other words, the correction amount coincides with the correction amount required in this state, so that generation of dragging can be eliminated suitably.

Note that, when the correction amount θ is determined in proportion to the magnitude of the dragging velocity Vu, instead of the dragging ratio ε, a small correction amount θ would be calculated in the state 3 where a large correction amount θ is originally required, so that suitable correction may be impossible and dragging may not be eliminated swiftly.

<Others>

While the target velocity vector Vt has been corrected by being rotated by a rotational angle θ according to the magnitude of the dragging ratio ε in the above embodiment, the correcting method for the target velocity vector Vt is not limited to this, and other method may be adopted insofar as the correction reduces the excavation reaction force. For example, the magnitude of the rotational angle θ (in other words, the direction of the target velocity vector after correction) may be changed according to the direction of the target velocity vector Vt. In addition, the direction (angle) of the target velocity vector Vt after correction may be preliminarily determined according to the magnitude of the dragging ratio ε, and a rotational angle necessary for reaching the direction may be added to the target velocity vector Vt, thereby achieving correction. Further, attention may be paid to the perpendicular component (component perpendicular to the construction target surface) of the target velocity vector, and an upward vector may be added to the perpendicular component (normally in a downward direction), to thereby correct the target velocity vector.

While a case where the dragging velocity Vu is corrected by calculating the inclination angle of the machine body 5 by the inclination angle calculation section 720 has been described in the above embodiment, when it can be assumed that the machine body 5 is moved on a plane of a predetermined inclination angle, the dragging velocity Vu can be calculated by utilizing the predetermined inclination angle, so that the calculation of the inclination angle by the inclination angle calculation section 720 can be omitted. In other words, the inclination angle calculation section 720 can be omitted, and the calculation in step S140 of FIG. 11 can be omitted.

The determination of the presence or absence of a traveling operation in step S130 of FIG. 11 may be conducted before step S120 or step S110.

While the actual operation velocity of the bucket claw tip has been utilized for the calculation of the dragging ratio ε in the above embodiment, the target operation velocity of the bucket claw tip may also be utilized. The target operation velocity of the bucket claw tip can be calculated from the target velocity vector calculated by the target velocity vector calculation section 810 or the target velocity vector after correction calculated by the target velocity vector correction section 930.

Note that the present invention is not limited to the above-described embodiment, but includes various modifications within such ranges as not to depart from the gist of the invention. For example, the present invention is not limited to the one that includes all the configurations described in the above embodiment, and includes those in which part of the configurations is deleted. In addition, a part of a certain configuration of an embodiment can be added to or substituted for the configuration of other embodiment.

Besides, each configuration of the above controller 34 and the function, the execution process, and the like of the configuration may be partly or entirely realized by hardware (for example, designing logics for executing each function in an integrated circuit or the like). In addition, the configurations of the controller 34 may be a program (software) with which each function of the configurations of the controller 34 is realized by being read and executed by an arithmetic processing device (for example, CPU). The information concerning the program can be stored, for example, in a semiconductor memory (flash memory, SSD, etc.), magnetic storage device (hard disk drive, etc.) and recording media (magnetic disk, optical disk, etc.).

In addition, in the description of each of the above embodiments, control lines and information lines have been described which are interpreted as necessary for explanation of the embodiment, but all control lines and information lines concerning the product are not necessarily shown. In practice, substantially all the configurations may be considered to be connected to one another.

DESCRIPTION OF REFERENCE CHARACTERS

1: Hydraulic excavator (work machine)
2: Front work device
3: Swing structure
4: Track structure
5: Machine body
20: Boom
20A: Boom cylinder
20S: IMU sensor (boom)
21: Arm
21A: Arm cylinder
21S: IMU sensor (arm)
22: Bucket
22A: Bucket cylinder
22B: First link member
22C: Second link member
22S: IMU sensor (bucket)
30S: IMU sensor (swing structure)
31: Main frame
32: Cab
33: Operation input device
33*a*: Operation lever
33*b*: Operation sensor
33*c*: Traveling operation lever
34: Main controller
35: Hydraulic pressure controller
35*a*: Solenoid control valve
35*b*: Directional control valve (control valve)
36*a*: Engine (prime mover)
36*b*: Hydraulic pump
37: Distance measuring sensor
40: Track frame
46: Crawler
100: Target surface management device (target surface management controller)
110: Monitor (display device)
710: Front device posture/velocity calculation section
720: Inclination angle calculation section
810: Target velocity vector calculation section
820: Target operation velocity calculation section
830: Operation command value calculation section
910: Velocity calculation section
920: Ratio calculation section
930: Target velocity vector correction section

The invention claimed is:

1. A work machine comprising:

a machine body having a track structure and a swing structure attached to an upper portion of the track structure;

an articulated work device attached to the swing structure;

a plurality of actuators that operate the work device;

an operation lever that instructs each of the plurality of actuators on an operation according to an operator's operation; and a controller configured to calculate a target velocity vector of the work device such that a position of the work device is maintained on a predetermined construction target surface or above an upper side thereof while the operation lever is operated, and perform an area restriction control of controlling at least one of the plurality of actuators such that the work device is operated according to the calculated target velocity vector, wherein the controller is configured to calculate an operation velocity of the work device in a machine body coordinate system and a movement velocity of the machine body in a gravity coordinate system, and correct a direction of the calculated target velocity vector upward away from the construction target surface when occurrence of dragging is detected during execution of the area restriction control based on the calculated operation velocity of the work device and the calculated movement velocity of the machine body.

2. The work machine according to claim 1, wherein the controller is configured to:

set the movement velocity of the machine body to zero when the machine body is traveling by an operation of the track structure; and calculate a dragging ratio that is a ratio of the movement velocity of the machine body with respect to the operation velocity of the work device, and detect occurrence of the dragging when the calculated dragging rate is not zero.

3. The work machine according to claim 2, wherein the controller is configured to calculate a correction amount of the target velocity vector based on the dragging ratio, and a relation between the dragging ratio and the correction amount of the target velocity vector in the calculation is a monotonous increase relation in which the correction amount of the target velocity vector increases with an increase in the dragging ratio.

4. The work machine according to claim 1, wherein the controller is configured to calculate a distance between the construction target surface and the work device, and calculate a correction amount of the target velocity vector based on the calculated distance, and a relation between the distance and the correction amount of the target velocity vector in the calculation of the correction amount of the target velocity vector is a monotonous increase relation in which the correction amount of the target velocity vector increases with an increase in the distance.

5. The work machine according to claim 1, wherein the controller is configured to calculate a correction amount of the target velocity vector based on a magnitude of the target velocity vector, and a relation between the magnitude of the target velocity vector and the correction amount of the target velocity vector in the calculation is a monotonous increase relation in which the correction amount of the target velocity vector increases with an increase in the magnitude of the target velocity vector.

6. The work machine according to claim 1, further comprising:

a monitor that displays at least one of a posture of the work device, a posture of the machine body, and a distance between the construction target surface and the work device, wherein the controller displays that the target velocity vector has been corrected on the monitor when the target velocity vector has been corrected.

7. The work machine according to claim 1, comprising:

a plurality of inertia measuring devices each attached to each of a plurality of front members constituting the work device, wherein the controller is configured to calculate an operation velocity of the work device in the machine body coordinate system based on output values of the plurality of inertia measuring devices.

8. The work machine according to claim 1, comprising:

at least one of a distance measuring sensor that measures variation in distance between a specified place and the machine body, an inertia measuring device attached to the swing structure, a velocity sensor that detects a movement velocity of the machine body, and a receiver that receives positioning signals from a plurality of positioning satellites to measure a position of the machine body, wherein the controller is configured to calculate a movement velocity of the machine body in a gravity coordinate system based on at least one of output values from the distance measuring sensor, the inertia measuring device, the velocity sensor, and the receiver.

* * * * *